US009631341B2

(12) United States Patent
McKee et al.

(10) Patent No.: US 9,631,341 B2
(45) Date of Patent: Apr. 25, 2017

(54) VEHICLE

(71) Applicant: J. C. Bamford Excavators Limited, Uttoxeter, Staffordshire (GB)

(72) Inventors: Michael McKee, Uttoxeter (GB); Matt Cook, Uttoxeter (GB)

(73) Assignee: J.C. Bamford Excavators Limited, Uttoxeter, Staffordshire (GB)

( * ) Notice: Subject to any disclaimer, the term of this patent is extended or adjusted under 35 U.S.C. 154(b) by 114 days.

(21) Appl. No.: 14/748,843

(22) Filed: Jun. 24, 2015

(65) Prior Publication Data

US 2015/0376865 A1 Dec. 31, 2015

(30) Foreign Application Priority Data

Jun. 25, 2014 (GB) ..... 1411302.1

(51) Int. Cl.
*E02F 9/08* (2006.01)

(52) U.S. Cl.
CPC ..... *E02F 9/085* (2013.01)

(58) Field of Classification Search
CPC ..... E02F 9/085
See application file for complete search history.

(56) References Cited

U.S. PATENT DOCUMENTS 4,288,196 A 9/1981 Sutton, II
5,580,095 A 12/1996 Fukumoto
2004/0010359 A1 1/2004 Koch
2004/0117093 A1* 6/2004 Koch ..... E02F 3/435 701/50
2006/0082079 A1 4/2006 Eichhorn et al.
2009/0127531 A1 5/2009 Bakshi

FOREIGN PATENT DOCUMENTS

WO WO-2006/047836 A1 5/2006

OTHER PUBLICATIONS

Search Report for European Patent Application No. 15 17 0339, dated Dec. 1, 2015.
Search Report for GB Patent Application No. 1411302.1, dated Jan. 13, 2015.

* cited by examiner

*Primary Examiner* — Basil T Jos
(74) *Attorney, Agent, or Firm* — Marshall, Gerstein & Borun LLP

(57) ABSTRACT

A method of orientating a materials handling vehicle to a desired angle includes providing a first and second stabilizers on the right and left sides, respectively, of a chassis and being selectively engageable with the ground, providing a controller to control operation of the first and second stabilizers in response to an input, positioning the vehicle on ground with the first and second stabilizers being disengaged from the ground such that the chassis is at an initial roll angle, providing a desired roll angle, providing an input to the controller requiring deployment of the stabilizers to simultaneously deploy the first and second stabilizers, and upon detection of a change in roll angle away from the desired roll angle caused by engagement of one of the stabilizers with the ground, the controller automatically stops deployment of one stabilizers and continues deployment of the other stabilizer.

18 Claims, 2 Drawing Sheets

VEHICLE

FIELD OF THE INVENTION

The present invention relates to a method of operating a vehicle, in particular a working vehicle.

BACKGROUND OF THE INVENTION

Known working vehicles, such as back hoe loaders have a materials handling implement such as a loading shovel mounted on the front of the machine and a further materials handling implement such as a back hoe, mounted on the back of a machine.

When the operator wishes to use the loading shovel the seat is orientated in a forwards facing direction and the operator can use controls such as the steering wheel, a foot brake, a foot clutch, a foot accelerator, a gear box having forward and reverse gears to move the vehicle over the ground. Hand operated controls can also be used to lift and lower a loading arm and crowd or dump the loading shovel. Accordingly material can be manoeuvred.

When it is necessary to move the back hoe loader from one location to another location, typically via public highway, the loading shovel will be lifted above ground level and the back hoe loader can be driven, in the manner of a car (automobile) with the operator facing forwards and using the steering wheel, brake, clutch and throttle controls.

When using the back hoe the seat can be rotated to face rearwardly. When using the back hoe the vehicle will be stationary, and indeed some or all of the wheels may be lifted off the ground by operation of stabilizer legs and/or lowering of the front shovel into engagement with the ground. Known back hoe loaders have a stabilizer on the rear right hand side of the machine and a further stabilizer on the rear left hand side of the machine. Each stabilizer is controlled individually by a separate operator input, i.e. there is one operator input which only controls the right hand stabilizer and a further operator input which only controls the left hand stabilizer. Prior to using the back hoe each stabilizer is engaged with the ground. Typically it is desirable for the rear right and rear left stabilizers to lift the chassis of the vehicle slightly such that the weight of the vehicle is taken on the stabilizers and removed from the wheels, in particular the pneumatic tires of the wheels. Taking weight of the vehicle on the stabilizers and removing it from the tires means that during operation the vehicle will not rock on the pneumatic tires. Furthermore, because each stabilizer is individually controllable, then it is possible to orientate the vehicle at a desired roll angle. Setting the vehicle at a desired roll angle is important since it orientates the generally vertical pivot about which the back hoe swings. Typically the operator will engage both stabilizers with the ground and then adjust both until the desired roll angle has been achieved and sufficient weight of the vehicle has been taken by the stabilizers.

Clearly, the final adjustments of the individual stabilizers is time consuming and delays use of the back hoe.

SUMMARY OF THE INVENTION

An object of the present invention is to provide an improved vehicle.

Thus, according to a first aspect of the present invention there is provided a method of automatically orientating a materials handling vehicle to a desired angle, the method including providing the vehicle with ground engaging transport means operably connected to a chassis of the vehicle, providing a first stabilizer towards a right hand side of the vehicle, the first stabilizer being selectively engageable with the ground to lift a right hand side of the chassis, providing a second stabilizer towards a left hand side of the vehicle, the second stabilizer being selectably engageable with ground to lift the left hand side of the chassis, providing a controller to control operation of the first and second stabilizers in response to an operator input, the method including the steps of positioning the vehicle on ground with the first and second stabilizers being disengaged from the ground such that the chassis is at an initial roll angle, providing a desired roll angle, providing an operator input to the controller requiring deployment of the stabilizers such that the controller simultaneously deploys the first and second stabilizers, wherein upon detection of a change in roll angle away from the desired roll angle caused by engagement of one of the stabilizers with the ground, the controller automatically stops deployment of said one of the stabilizers and continues deployment of the other of the stabilizers until the desired roll angle is achieved.

Advantageously the controller automatically adjusts the roll angle to the desired roll angle, thereby saving time and hence increasing productivity.

The desired roll angle may be perpendicular to the direction of gravity. The desired roll angle may be different from perpendicular to the direction of gravity. The material handling vehicle may include a ground engaging implement operable to dig or otherwise manipulate the ground.

According to a second aspect of the present invention there is provided a method of automatically orientating a materials handling vehicle to a desired angle, the method including providing the vehicle with ground engaging transport means operably connected to a chassis of the vehicle, providing a first stabilizer towards a right hand side of the vehicle, the first stabilizer being selectively engageable with the ground to lift a right hand side of the chassis, providing a second stabilizer towards a left hand side of the vehicle, the second stabilizer being selectably engageable with ground to lift the left hand side of the chassis, providing a controller to control operation of the first and second stabilizers in response to an operator input, the method including the steps of positioning the vehicle on ground with the first and second stabilizers being disengaged from the ground such that the chassis is at an initial roll angle, providing a desired roll angle, providing an operator input to the controller requiring deployment of the stabilizers such that the controller simultaneously deploys the first and second stabilizers, wherein upon detection of a change in roll angle towards the desired roll angle caused by engagement of one of the stabilizers with the ground, the controller automatically stops deployment of the other of the stabilizers and continues deployment of the said one of the stabilizers until the desired roll angle is achieved.

According to a further aspect of the present invention there is provided a method of operating a material handling vehicle including using the method of the second aspect of the present invention to automatically orientate the material handling vehicle to a desired angle, the material handling vehicle including a ground engaging implement, the method including the subsequent step of using the ground engaging implement to engage the ground to manipulate the ground.

BRIEF DESCRIPTION OF THE DRAWINGS

The invention will now be described, by way of example only, with reference to the accompanying drawings in which.

DETAILED DESCRIPTION

Figure 1:
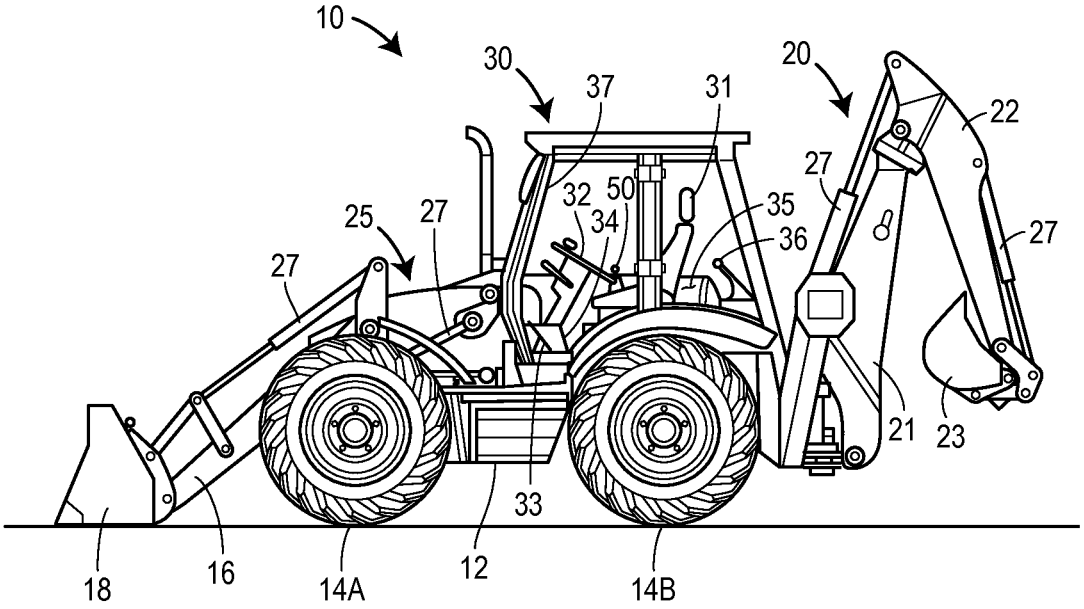
FIG. 1 is a side view of a vehicle according to the present invention.
Figure 2:
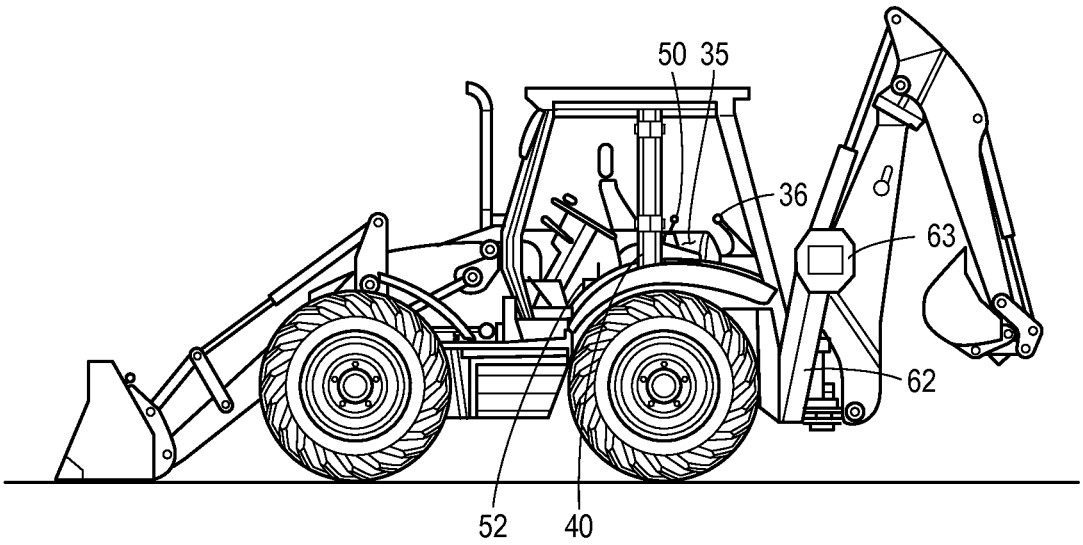
FIG. 2 is a side view of the vehicle of FIG. 1 with the operator seat facing rearwardly.
Figure 3:
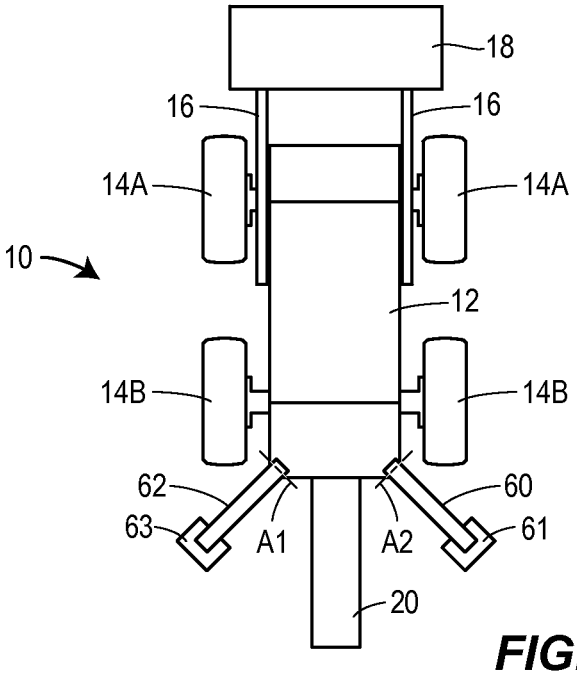
FIG. 3 shows a plan schematic view of the vehicle of FIGS. 1 and 2.

With reference to FIGS. 1 to 3 there is shown a material handling vehicle in the form of a back hoe loader 10 having a chassis 12 supported by ground engaging motive (or transport) means in the form of front wheels 14A and rear wheels 14B. Mounted on the chassis is a loading arm 16 at the front of which is mounted an implement, in this case a loading shovel 18. The loading arm and loading shovel are mounted on the front of the vehicle.

The vehicle also includes a rear right stabilizer 60 and rear left stabilizer 62 (see FIG. 3). The rear left stabilizer is pivotally mounted to the chassis of the vehicle about a generally horizontal axis A1. A hydraulic ram (not shown) can be operated to move the rear left stabilizer from the retracted position as shown in FIG. 2 to a deployed position as shown in FIG. 3 such that the pad 63 engages the ground.

Similarly, the rear right stabilizer is pivotally attached to the chassis about a generally horizontal axis A2. A hydraulic ram (not shown) can be operated to pivot the rear right stabilizer 60 from a retracted position to a deployed position as shown in FIG. 3 such that the pad 61 engages the ground.

Mounted on the back of the vehicle is a back hoe 20 having a boom 21, a dipper arm 22, and a bucket 23 (see FIG. 1). The vehicles includes an engine 25 which provides power to drive the vehicle over the ground. The engine 25 also provides power to operate a hydraulic pump which can selectively provide pressurised hydraulic fluid to the various rams 27 of the vehicle to operate the loading arm, loading shovel, boom, dipper, bucket, rear right stabilizers, rear left stabilizers etc so as to enable material to be handled. The vehicles includes an operator cab 30 including an operator seat 31. The operator cab includes operator controls such as a steering wheel 32, a foot brake 33, a foot throttle 34, a hand throttle 35 and back hoe control lever 36.

As shown in FIG. 1 the operator seat 31 is facing forwards. The operator seat is rotatable and can be rotated to the position shown in FIG. 2 where it faces the rear of the vehicle.

The back hoe loader 10 also includes an operator input device 50 and a controller 52.

In summary, the stabilizers can be automatically deployed and can move the machine to a desired roll angle. Automatic deployment of the stabilizers saves time thereby enabling the operator to start to use the back hoe sooner than would otherwise be the case and this increases productivity.

In more detail, the operator input device provides an operator to machine interface. By using the operator input device 50, a desired roll angle can be input. The roll angle may be defined relative to the local ground surface. For example the roll angle may be defined as being parallel to the local ground surface. Alternatively the roll angle may be defined as any other angle which is non-parallel to the ground.

Alternatively, the roll angle may be defined relative to a global coordinate system such as the direction of gravity. The roll angle may be defined as being perpendicular to the direction of gravity. Alternatively the roll angle may be defined as any other angle non-perpendicular to the direction of gravity.

The desired roll angle sets the angle of boom pivot axis 21A. The back hoe will rotate relative to the chassis about axis 21A. The rotational position about this axis of the boom defines the set of planes in which the boom, dipper arm and bucket can move.

In one example, it may be desired to dig a trench along a contour of sloping ground, the trench being vertical relative to gravity. Under these circumstances the desired roll angle would be set as perpendicular to gravity which would therefore not be parallel to the local ground surface.

Alternatively, it may be desired to dig a trench perpendicular to the local ground surface, in which case the desired roll angle would be set as parallel to the local ground surface. If the local ground surface was horizontal, then a vertical trench would be dug. However, if the local ground surface was sloping laterally, then the trench would slope equally.

Depending upon the implement being used with the back hoe and the task to be performed, then various roll angles other than perpendicular to gravity or parallel to the ground might be chosen. Such alternative roll angles might be used with pneumatic hammer attachments, hydraulic hammer attachments etc.

The operator input device can also be used to input a desired height of the rear of the vehicle above the ground. The height of the rear of the vehicle above the ground defines how much weight of the vehicle is carried by the stabilizers and how much might be carried by the rear tires. With the stabilizers in the fully retracted position, all the weight of the rear of the vehicle is carried by the rear tires. With the stabilizers fully deployed, the rear wheels will be lifted off the ground and therefore all of the weight of the rear of the vehicle will be carried by the stabilizers and none will be carried by the rear tires. Typically, the rear of the chassis may be lifted such that the majority of the weight of the rear of the vehicle is carried by the stabilizers or all of the weight of the rear of the vehicle is carried by the stabilizers. The rear tires may therefore typically be just in contact with the ground or just out of contact with the ground.

The controller 52 may include a roll sensor which can determine the instantaneous roll angle of the chassis. The roll sensor may be able to determine the instantaneous roll angle of the chassis relative to a global coordinate system.

Memory within the controller may be able to determine a roll angle when the stabilizers are in their retracted position. Such a roll angle defines the lateral slope of the local ground surface, since when stabilizers are in their retracted position, the roll angle of the chassis will be parallel to the local ground surface. If the local ground surface is on a lateral slope, then the chassis will be orientated at a similar angle to the lateral slope.

The controller may be connected to further sensors. The controller may be able to determine from the further sensors the amount of load of the rear of the vehicle being carried by the tires and/or the amount of load of the rear of the vehicle being carried by the stabilizers when in a deployed position.

Operation of the back hoe loader 10 is as follows:

The operator will drive the vehicle to a desired location where work is to be carried out. In this example the location is on a slope such that the right hand side of the vehicle is higher than the left hand side of the vehicle. The operator then turns the seat to face rearwardly as shown in FIG. 2 and inputs a desired roll angle. In this example the desired roll angle is a roll angle defined relative to a global coordinate system, in this case perpendicular relative to the direction of gravity. The operator also inputs a desired height of the rear of the vehicle above the ground. In this example the height is such as to ensure all of the weight of the rear of the vehicle is taken by the stabilizers and the rear tires will therefore just be clear of the ground.

The operator then provides an operator input to the controller requiring deployment of the stabilizers. In this example, the operator presses a single button, for example labelled "deploy stabilizers". It is the controller that then automatically deploys the stabilizers. The controller automatically simultaneously deploys the rear right and rear left stabilizers. As each stabilizer pivots downwardly about its axis, one of the stabilizers will touch the ground first, in this example the rear right stabilizer touches the ground before the rear left stabilizer. As the rear right stabilizer touches the ground the chassis is tipped (or rolls) to the left, i.e. it rolls away from the desired roll angle. The controller senses this change in roll angle and automatically stops deployment of the rear right stabilizer but continues to deploy the rear left stabilizer. The rear left stabilizer will then contact the ground and tip (or roll) the chassis towards the desired roll angle. The controller can monitor this rolling action and can determine when the instantaneous roll angle matches the desired roll angle. If when the instantaneous roll angle matches the desired roll angle the weight of the rear of the vehicle is being carried solely by the rear right and rear left stabilizers, then the controller automatically stops any further deployment of the rear left stabilizer.

However, if when the instantaneous roll angle matches the desired roll angle, some of the weight of the rear of the vehicle is still being carried by the rear tires, then the controller will continue deployment of the rear left stabilizer and start deployment of the rear right stabilizer. This will cause the rear of the chassis to lift at the desired roll angle. Once the rear of the chassis has been lifted such that none of the weight of the rear of the vehicle is carried by the rear tires (i.e. all of the weight of the rear of the vehicle is carried by the stabilizers) then the controller simultaneously ceases deployment of the rear right and rear left stabilizer.

The machine is then positioned at the correct roll angle and the operator can then use the back hoe, for example to start to dig a trench. If the trench is a long trench, then once the first part of the trench is being dug the operator will then retract the stabilizers, turn the seat to face forwards as shown in FIG. 1, drive the machine forwards a short distance, perhaps the length of the vehicle, turn the seat to face rearwardly as shown in FIG. 2. At this point the stabilizers will still be in the retracted position. Because the operator has already provided a desired roll angle, it is no longer necessary to re-input this desired roll angle. Accordingly, all that is required is for the operator to press the single button. The controller will then automatically simultaneously deploy the stabilizers and the machine will be quickly positioned at the desired roll angle with the rear of the vehicle being at the desired height such that the operator can quickly continue to use the back hoe to dig a trench.

The operator can continue to dig the trench throughout the day progressively moving the machine forwards and deploying the stabilizers quickly.

In particular, once the operator has set the desired roll angle and has set the desired height of the rear of the vehicle above the ground, then all is required is a single push of the button to deploy the stabilizers to the correct position.

Note that some back hoe loader operators may only ever use a bucket as the attachment on the end of the dipper arm. These operators may only ever dig trenches, and as such once the initial desired roll angle has been input and once the initial desired height of the rear of the vehicle above the ground has been input, it may never again be necessary to change these two inputs. Under these circumstances deployment of the rear stabilizers can always be carried out by a simple pushing of the button.

As will be appreciated, when using the present invention time is not wasted by the operator having to individually control deployment of both the right and left stabilizers.

Advantageously it is possible to provide an override system which ceases automatic deployment of the stabilizers. In one example, in order to automatically deploy the stabilizers the operator input device is in the form of a single button which must be continuously depressed until such time as the stabilizers has been deployed to the final position. Should the operator decide to cease automatic deployment of the stabilizers, then the operator simply ceases to depress the button. The controller can sense the cease in deployment of the button and therefore stops deploying the stabilizers. Should the operator then decide to continue to deploy the stabilizers, then the operator presses the single button again whereupon automatic deployment of the stabilizers continues until such time as the desired roll angle and height of the rear of the vehicle are achieved where upon the controller automatically stops deployment of the stabilizers.

In the example above, because the rear right stabilizer touch the ground first, the chassis rolled away from the desired roll angle. In an alternative scenario the rear left stabilizer may have touched the ground first, in which case the chassis will roll towards the desired roll angle. Under these circumstances the controller senses this change in roll angle and automatically continues to deploy the rear left stabilizer until the desired roll angle is achieved. If when the instantaneous roll angle matches the desired roll angle the weight of the rear of the vehicle is being carried solely by the rear right and rear left stabilizers, then the controller automatically stops any further deployment of the rear left stabilizer.

However, if when the instantaneous roll angle matches the desired roll angle, some of the weight of the rear of the vehicle is still being carried by the rear tires, then the controller will continue deployment of the rear left stabilizer and start deployment of the rear right stabilizer. This will cause the rear of the chassis to lift at the desired roll angle. Once the rear of the chassis has been lifted such that none of the weight of the rear of the vehicle is carried by the rear tires (i.e. all of the weight of the rear of the vehicle is carried by the stabilizers) then the controller simultaneously ceases deployment of the rear right and rear left stabilizers.

As described above, the controller automatically deploys the stabilizers until such time as the desired roll angle has been achieved and the desired height of the rear of the vehicle above the ground has been achieved. In further embodiments the controller may operate simply until such time as the desired roll angle has been achieved.

In a further embodiment a desired pitch angle of the chassis may be input into the operator input device. The control system may automatically adjust the pitch of the vehicle, in particular by deploying a further ground engaging means, in one example by deploying the moving arm 16 such that the loading shovel 18 engages the ground and lifts the front of the chassis so that the desired pitch angle is achieved. Automatic adjustment of the pitch may occur after automatic adjustment of the roll angle. Alternatively automatic adjustment of the pitch may occur at the same time as automatic adjustment of the roll angle is occurring.

As described above, pitch may be controlled by deploying the moving arm 16 such that the loading shovel 18 engages the ground and lifts the front of the chassis. In an alternative embodiment the machine may have more than two stabilizer legs, in particular the machine may have four stabilizer. The stabilizers may pivot into engagement with the ground and/or may be deployed vertically to translate into engagement with the ground.

As described above, the stabilizers pivot relative to the ground. The invention is equally applicable to other types of stabilizers, in particular stabilizers which are deployed vertically, i.e. the stabilizer translates vertically downwardly to its deployed position (rather than rotating about a generally horizontal axis).

In further embodiments the system may determine an initial roll angle of the vehicle prior to deploying the stabilizers. If such an initial roll angle is higher than a predetermined roll angle then the system may prevent automatic leveling of the machine. The machine may still be leveled, though this leveling will then be done manually be the operator.

As described above the operator input is a single button or the like, In further embodiments the operator input could be by operating two input devices, for example manual control of the right stabilizer may be via a right stabilizer control lever and manual control of the left stabilizer may be via a left stabilizer control lever. These levers may be sprung to a centre position. Movement of one lever in one direction may cause lifting of the associated stabilizer and movement of the lever in another direction may cause lowering of the associated stabilizer. Under such circumstances in order to use automatic leveling then both levers can be moved together in one movement to a detent position or the like to indicate that automatic leveling is required.

As described above, once the desired roll angle has been achieved, then automatic roll control ceases. However, in further embodiments automatic roll control may continue after the desired roll angle has been achieved. Thus, once the desired roll angle has been achieved, significant weight will be on the stabilizer pads which may start to sink into the ground. If one stabilizer pad sinks into the ground more than another then the roll angle will change. The system may be configured to monitor roll angle and correct roll angle. The roll angle may be corrected within a predetermined amount of time of the desired roll angle being achieved, for example correction may occur within a 10 second period or 1 minute period or 2 minute period after the desired roll angle is achieved. Alternatively, as the machine is operated, this may cause the stabilizer to sink into the ground further. Accordingly, correction may occur during operation of the machine.

The invention claimed is:

1. A method of automatically orientating a materials handling vehicle to a desired angle, the method including providing the vehicle with ground engaging transport means operably connected to a chassis of the vehicle, providing a first stabilizer towards a right hand side of the vehicle, the first stabilizer being selectively engageable with the ground to lift a right hand side of the chassis, providing a second stabilizer towards a left hand side of the vehicle, the second stabilizer being selectably engageable with ground to lift the left hand side of the chassis, providing a controller to control operation of the first and second stabilizers in response to an operator input, the method including the steps of positioning the vehicle on ground with the first and second stabilizers being disengaged from the ground such that the chassis is at an initial roll angle, providing a desired roll angle, providing an operator input to the controller requiring deployment of the stabilizers such that the controller simultaneously deploys the first and second stabilizers, wherein upon detection of a change in roll angle away from the desired roll angle caused by engagement of one of the stabilizers with the ground, the controller automatically stops deployment of said one of the stabilizers and continues deployment of the other of the stabilizers until the desired roll angle is achieved.

2. A method as defined in claim 1 wherein when the desired roll angle is achieved the controller automatically stops deployment of the other stabilizer.

3. A method as defined in claim 1 wherein when the desired roll angle is achieved the controller continues deployment of the other stabilizer and starts deployment of said one of the stabilizers so as to lift the chassis at the desired roll angle.

4. A method as defined in claim 3 where upon reaching a desired height of the chassis above the ground the controller automatically stops deployment of the stabilizers to cease lifting of the chassis.

5. A method of automatically orientating a materials handling vehicle to a desired angle, the method including providing the vehicle with ground engaging transport means operably connected to a chassis of the vehicle, providing a first stabilizer towards a right hand side of the vehicle, the first stabilizer being selectively engageable with the ground to lift a right hand side of the chassis, providing a second stabilizer towards a left hand side of the vehicle, the second stabilizer being selectably engageable with ground to lift the left hand side of the chassis, providing a controller to control operation of the first and second stabilizers in response to an operator input, the method including the steps of positioning the vehicle on ground with the first and second stabilizers being disengaged from the ground such that the chassis is at an initial roll angle, providing a desired roll angle, providing an operator input to the controller requiring deployment of the stabilizers such that the controller simultaneously deploys the first and second stabilizers, wherein upon detection of a change in roll angle towards the desired roll angle caused by engagement of one of the stabilizers with the ground, the controller automatically stops deployment of the other of the stabilizers and continues deployment of the said one of the stabilizers until the desired roll angle is achieved.

6. A method as defined in claim 5 wherein when the desired roll angle is achieved the controller automatically stops deployment of said one of the stabilizers.

7. A method as defined in claim 5 wherein when the desired roll angle is achieved the controller continues deployment of said one of the stabilizers and starts deployment of the other stabilizer so as to lift the chassis at the desired roll angle.

8. A method as defined in claim 7 where upon reaching a desired height of the chassis above the ground the controller automatically stops deployment of the stabilizers to cease lifting of the chassis.

9. A method as defined in claim 5 wherein the desired roll angle is defined relative to the local ground surface.

10. A method as defined in claim 5 wherein the desired roll angle is defined relative to a global coordinate system.

11. A method as defined in claim 5 including defining a rate at which the stabilizers are to be deployed and subsequently deploying the stabilizers at the predefined rate.

12. A method as defined in claim 5 including providing a manual override to cease automatic deployment of the stabilizers.

13. A method as defined in claim 5 wherein the operator input is provided by actuating a single operator input device such as a single switch, a single lever, a single button or the like.

14. A method as defined in claim 13 wherein manual override is provided by de-actuating said single operator input device.

15. A method as defined in claim 5 including providing a desired pitch angle, and providing an operator input to the controller for requiring changing of the pitch angle from a current pitch angle to the desired pitch angle such that the controller automatically deploys a further grounding engaging means until the desired pitch angle is achieved.

16. A method as defined in claim 15, comprising a subsequent step of automatically repeating the method of claim 15.

17. A method as defined in claim 5 including determining an initial roll angle, providing a predetermined maximum roll angle, and if the initial roll angle is greater than the predetermined maximum roll angle then the method includes the step of preventing automatic orientation of the material handling vehicle to the desired angle.

18. The method as defined in claim 5, comprising a subsequent step of automatically repeating the method of claim 5.

* * * * *